United States Patent [19]

Roof

[11] Patent Number: 4,494,674

[45] Date of Patent: Jan. 22, 1985

[54] RESEALABLE CLOSURE AND CONTAINER STRUCTURE

[76] Inventor: G. Wayne Roof, P.O. Box 1116, Coolidge, Ariz. 85228

[21] Appl. No.: 575,151

[22] Filed: Jan. 30, 1984

[51] Int. Cl.[3] ..... B65D 41/16; B65D 41/18

[52] U.S. Cl. ..... 220/306; 220/308

[58] Field of Search ..... 220/306, 308; 150/55

[56] References Cited

U.S. PATENT DOCUMENTS 4,418,833 12/1983 Landis ..... 220/306

4,457,447 7/1984 Kirkis ..... 220/306

*Primary Examiner*—George T. Hall

*Attorney, Agent, or Firm*—Herbert E. Haynes, Jr.

[57] ABSTRACT

A container structure including a container body having an endless rim which defines an open top and having a lid which is demountably attached to the container body by at least a pair of relatively small spaced apart latching lugs. The latching lugs extend inwardly from a depending lip provided on the lid and releasably grip the rim of the container body in a manner which provides and maintains a laterally spaced relationship between the rim of the container body and the inner surface of the depending lip of the lid to facilitate removal and reinstallation of the lid by minimizing frictional engagement between the lid and the container body.

20 Claims, 5 Drawing Figures

RESEALABLE CLOSURE AND CONTAINER STRUCTURE

BACKGROUND OF THE INVENTION

1. Field of the Invention

This invention relates in general to containers and more particularly to an especially configured container body and closure lid combination which coact to provide a reusable selfsealing container which is easy to open and close.

2. Description of the Prior Art

The container art is replete with a tremendous variety of structures which are suitable for containment of various substances. Some containers are designed to be destroyed upon opening, at least as far as their sealing capability is concerned, while others are intended to be resealable. Some of the resealable containers, of course, are easier to use than others, and some are more successful with regard to their resealing capability than others. In general, those containers which are easy to open and reclose are less than ideal with regard to their sealing capabilities, and those which have good sealing capabilities are either difficult to open and reclose or are too complex and expensive to be employed for many containerization tasks.

Therefore, a need exists for a new and improved resealable container structure which overcomes some of the problems and shortcomings of the prior art.

SUMMARY OF THE INVENTION

In accordance with the present invention, a new and improved resealable container structure is disclosed which is inexpensive to fabricate and simple to use, with the container structure including, in combination, a container body upon which a closure lid is demountably carried. The container body has an endless rim formed about its open top with the rim extending laterally from the body to provide an upwardly facing sealing surface which lies in a plane transverse with respect to the vertical axis of the container body. The rim is further provided with an endless depending flange having a downwardly facing edge. The closure lid is a substantially planar structure having an endless depending peripheral lip, with the inner surface of the lip having at least a pair of spaced apart latching lugs integrally formed thereon. The latching lugs interact with the downwardly facing edge of the rim of the container body to releasably hold the lid on the container body, with the lid being held down in sealing engagement with the upwardly facing sealing surface of the container body's rim. The latching lugs are configured to provide an interference fit with the flange portion of the container body's rim so that the downwardly facing edge of the rim will snap into grooves provided on the latching lugs when the closure lid is pushed down onto the container body. The latching lugs are configured so that the grooves defined thereby are inwardly offset with respect to the inner surface of the depending lip of the closure lid. In this manner, when the lid is mounted on the container body, the lip of the lid and the flange of the container body will be in a spaced apart relationship to minimize friction which could otherwise hamper the ease of installation and removal of the lid. The frictional contact between the lid and the rim of the container body is limited to the areas where the latching lugs are located, and the latching lugs are especially configured to minimize the frictional engagement of the latching lugs with the rim of the container body. Each of the latching lugs is provided with a bead at the lower end thereof with an angularly and outwardly inclined surface extending upwardly from the bead. The groove defined by the latching lug is located at the juncture of the bead and the inclined surface, and the bead is preferably of arcuate cross section. When the closure lid is being pushed onto, or removed from the container body, the only frictional contact therebetween will be where the arcuate surface of the bead rides on the outwardly facing flange portion of the container body rim. The inclined surface locates the groove of the latching lug in the desired inwardly offset position, and by virtue of its angular attitude, will not come into frictional engagement with the flange of the container body rim.

The combination container structure described above is ideally suited for use in containerization of various substances which need to be protected from contamination by airborne matter, and the like. However, the seal provided by the lid being in contact with the upwardly facing sealing surface of the container body's rim could prove to be inadequate when, for example, the container structure is filled with a liquid and is to be shipped. Therefore, the sealing capabilities of the container structure of the present invention may be enhanced by providing an endless flange which extends from the closure lid in the same direction as the depending lip, and is spaced inwardly therefrom. The flange is provided with a groove in its outwardly facing surface for retaining an O-ring type seal. When the closure lid is mounted on the container body, the O-ring seal will engage the inner surface of the container body and thereby provide the container structure of the present invention with highly reliable sealing capabilities with minimal effect on the ease of opening and reclosing of the structure.

Accordingly, it is an object of the present invention to provide a new and improved container structure.

Another object of the present invention is to provide a new and improved container structure which is inexpensive to fabricate and simple to use.

Another object of the present invention is to provide a new and improved sealed container structure which includes, in combination, a container body having a closure lid which may be repeatedly removed and replaced with minimal effort.

Another object of the present invention is to provide a new and useful container structure of the above described character wherein the closure lid is provided with a depending peripheral lip having at least a pair of spacedly arranged latching lugs which releasably and sealingly hold the closure lid on the container body in a manner whereby the lip of the closure lid is in spaced relationship with respect to the rim of the container body to minimize frictional engagement therebetween.

Still another object of the present invention is to provide a new and improved resealable container structure of the above described type wherein the sealing capabilities of the container structure may be enhanced by providing a depending flange on the lid within the lip thereof and mounting an O-ring seal on the flange for sealingly engaging the inner surface of the container body.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
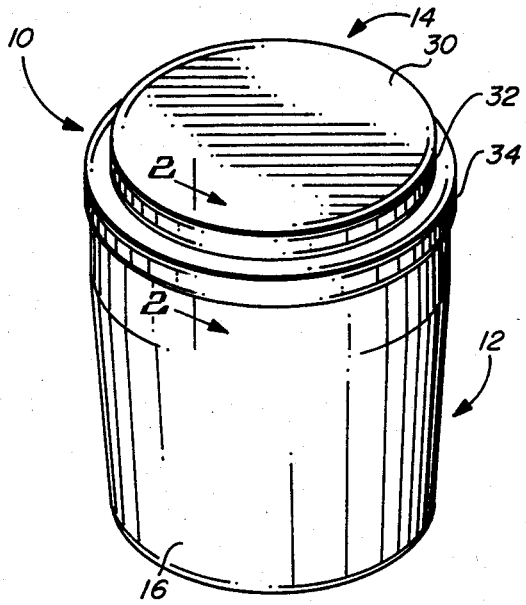
FIG. 1 is a perspective view of a typical type of container structure which includes the various features of the present invention.

Referring more particularly to the drawings, FIG. 1 shows a typical type of container structure which is indicated generally by the reference numeral 10. The container structure 10 includes, as shown, the combination of a container body 12 having a closure lid 14.

The illustrated container body 12 is of the well known type which is molded or otherwise formed as an integral one-piece structure from a suitable synthetic resin, and is seen to have a substantially circular cross section and may be either of cylindrical or inverted frustro conical configuration. As is customary, the container body 12 is closed on its bottom end (not shown) and has an integral upstanding endless sidewall 16 which is provided with a circular rim 18 which circumscribes the open top end 20 of the container body 12.

It will be understood that the illustrated container body 12 as described in detail above, is presented herein for completeness of this disclosure, and is not intended as a limitation of the present invention. It will become apparent as this description progresses, that the container body may be of any cross sectional configuration, such as square, rectangular, hexagonal, or the like. The important feature of the container body is that it be provided with an endless rim, such as that indicated at 18, with the rim defining the open top end of the container body.

The endless peripheral rim 18 of the container body 12 extends laterally from the open top end 20 of the container body to provide a sealing surface 22 which is preferably planar and which lies in a plane transverse to the vertical axis of the container body. The rim 18 further defines a flange surface 24 which depends from the laterally extending edge of the sealing surface 22 and a bottom surface 26 which extends inwardly from the lower edge 28 of the flange surface 24 to the sidewall 16 of the container body. It will be noted that the flange surface 24 is shown as sloping angularly downwardly and outwardly, and that the bottom surface 26 slopes angularly inwardly and upwardly. Although those angular orientations are not critical, they are preferred in that the juncture of those two surfaces form the lower edge 28 as being protruding and relatively sharp for reasons which will become apparent as this description progresses.

The closure lid 14 is also preferably molded or otherwise formed, as a one-piece structure from a suitable synthetic resin. The lid 14 is provided with a substantially planar body 30 which may, however, be formed with offset portions, such as indicated at 32, or ribs (not shown) for rigidification purposes as is customary in the art. The lid body 30 is provided with an endless depending peripheral lip 34 which, in the illustrated embodiment, has an inside diameter which is greater than the outside diameter of the rim 18 of the container body 12. In this manner, when the closure lid 14 is mounted on the container body 12, the lip 34 of the lid will concentrically circumscribe the rim 18 of the container body.

Figure 4:
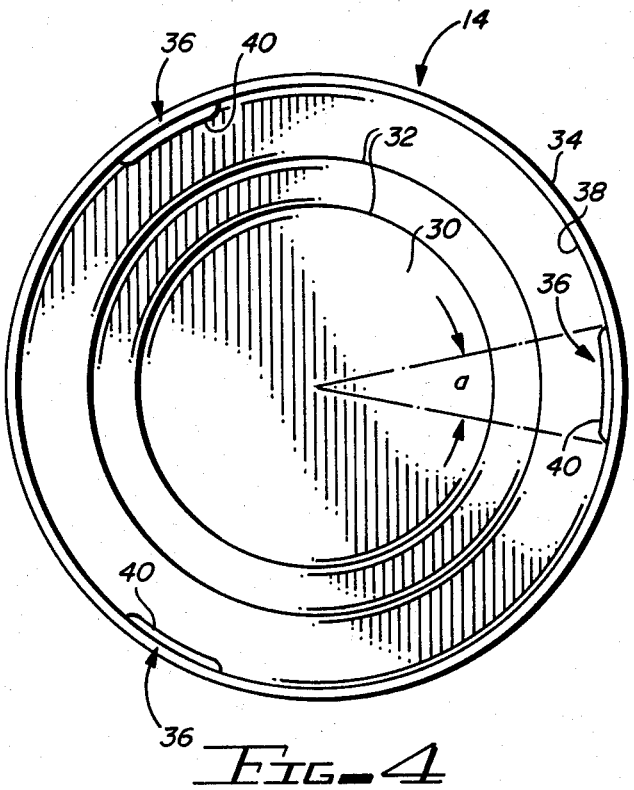
FIG. 4 is a bottom view of the closure lid which forms part of the combination of the present invention.

In accordance with the instant invention, the closure lid 14 is provided with at least a pair of latching lug means 36. In the illustrated embodiment, three of the latching lug means 36 are formed in equal spaced radial increments on the inwardly facing surface 38 of the depending lip 34 as shown in FIG. 4. The latching lug means 36 each extend inwardly from the surface 38 of the peripheral lip and each include a bead 40 of arcuate cross section which extends across the lower end of the latching lug proximate the lower end of the depending lip. The latching lug means 36 each further include an inclined surface 42 which extends upwardly from the bead 40 and slopes toward the inner surface 38 of the depending peripheral lip 34. As seen best in FIG. 2, the lower edge of the inclined surface 42 is set back, i.e., not tangential, with the arcuate surface of the bead, to provide a gripping means in the preferred form of a groove, or notch 44 at the juncture of the bead and the inclined surface.

The latching lugs 36 are sized so that they form an interference fit with the rim 18 of the container body 12. Therefore, when the closure lid 14 is placed atop the container body and pushed down, the inwardly extending portions of the beads 40 of the latching lugs 36 will ride downwardly on the flange surface 24 of the container body's rim 18. When the closure lid reaches the fully installed position, the lower edge 28 of the rim 18 will snap into the grooves 44 of the latching lugs 36, and the frictional engagement of the edges 28 of the rim 18 in the grooves 44 of the latching lugs 36 will firmly hold the lid 14 in place on the container body 12. In the illustrated embodiment, the frictional forces which hold the lid on the closure body are applied at three places, and they provide a minimal total area of frictional engagement in that the lengths of the grooves are very small in comparison to the total circumference of the lip 34 of the closure lid 14. More specifically, as shown in FIG. 4, the lengths of each bead 40, and thus the grooves 44, preferably have a length which may be defined as being included between a radial angle a of between 5° and 10°. Further, by virtue of the grooves 44 of the latching lugs 36 being inwardly offset with respect to the inner surface 38 of the lid's peripheral lip 34, the inner surface 38 of the lid is prevented from coming into frictional engagement with the flange surface 24 of the container body rim 18. The inclined surfaces 42 of the latching lugs 36, in conjunction with the beads 40, define the inwardly offset position of the grooves 44 and augment the spaced apart relationship of the peripheral lip 34 of the lid and the rim 18 of the container body by insuring that the inclined surfaces 42 will not come into frictional engagement with the rim of the container body.

Figure 2:
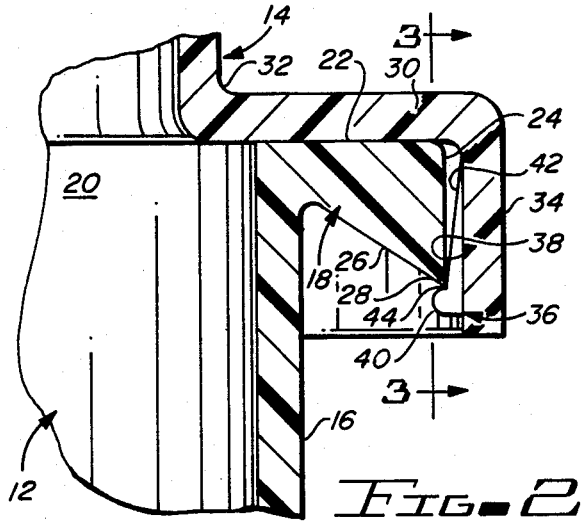
FIG. 2 is an enlarged fragmentary sectional view taken along the line 2—2 of FIG. 1.
Figure 3:
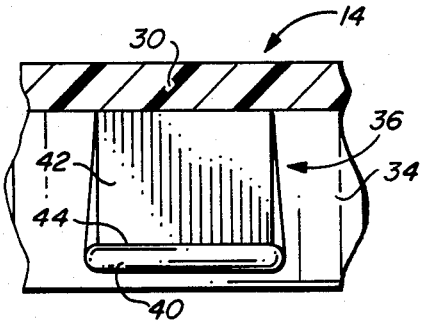
FIG. 3 is a fragmentary sectional view taken along the line 3—3 of FIG. 2.

As seen in FIG. 2, when the closure lid 14 is removably mounted on the container body 12, as described above, the downwardly facing surface of the lid's planar body 30 will be in bearing engagement with the upwardly facing sealing surface 22 of the closure body rim 18. This provides an excellent seal of the type which may be described as a dust seal, in other words, when the contents of the container structure are to be protected against environmental contamination, the closure lid 14 provides an excellent dust cover which is easy to install and remove. However, due to the relatively large radial spacing between the latching lugs 36, the container structure 10 is not provided with a seal which could be considered as being a hermetic, or leak-proof, seal.

Figure 5:
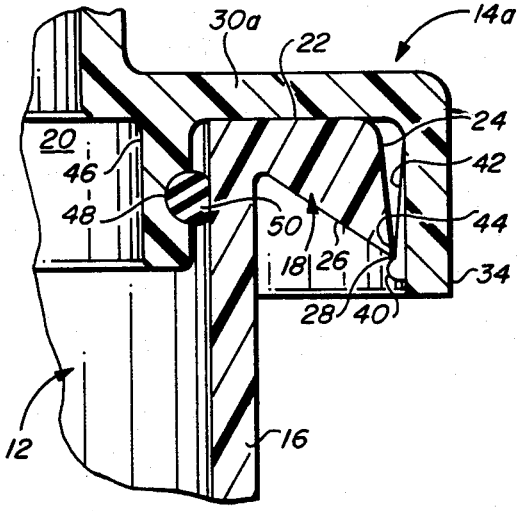
FIG. 5 is a sectional view similar to FIG. 2 and showing a modification of the present invention.

In the event that a hermetic, or leak-proof seal is required, such as for shipping purposes, a modification of the closure lid, as seen at 14*a* in FIG. 5, may be employed. In this modified closure lid 14*a*, the lid is identical to the hereinbefore described lid 14 with the exception of an endless flange 46 which is formed on the downwardly facing surface of the substantially planar closure body 30*a*. The endless flange 46 is concentric with respect to the peripheral lip 34 and is inwardly spaced therefrom. An endless groove 48 is provided in the outwardly facing surface of the flange 46 for demountably holding an O-ring type seal 50 therein. When the lid 14*a* is mounted on the container body 12, the O-ring seal 50 is in sealed engagement with the inner surface of the container body 12 and thus forms a hermetic, or leak-proof seal between the lid and the container body.

By providing the O-ring seal 50, in the manner described above, the ease of removal and reinstallation of the lid on the container body will be somewhat impaired. To restore this ease, the O-ring 50 can simply be removed after shipping, or the like, is finished.

While the principles of the invention have now been made clear in the illustrated embodiments, there will be immediately obvious to those skilled in the art, many modifications of structure, arrangements, proportions, the elements, materials, and components used in the practice of the invention, and otherwise, which are particularly adapted for specific environments and operation requirements, without departing from those principles. The appended claims are therefore intended to cover and embrace any such modifications within the limits only of the true spirit and scope of the invention.

What I claim is:

1. A container structure comprising in combination:

(a) container body means having an open top defined by an endless rim;

(b) closure lid means demountably mounted on said container body for closing the open top thereof, said closure lid having an endless depending peripheral lip which surrounds the rim of said container body; and (c) at least a pair of latching lug means in spaced relationship on the inwardly facing surface of the peripheral lip of said closure lid for releasably engaging the rim of said container body, said pair of latching lug means each extending inwardly from the peripheral lip of said closure lid to provide a spaced relationship between the rim of said container body and the peripheral lip of said closure lid.

2. A container structure as claimed in claim 1 wherein the endless rim on said container body means is provided with an upwardly facing surface.

3. A container structure as claimed in claim 2 wherein said closure lid means is formed with a substantially planar body from which the endless peripheral lip depends, said planar body having its downwardly facing surface in sealing engagement with the upwardly facing surface of the rim of said container body.

4. A container structure as claimed in claim 1 wherein each of said pair of latching lug means is configured to provide a gripping means for releasably gripping the rim of said container body, said gripping means being in inwardly spaced relationship with respect to the peripheral lip of said closure lid means.

5. A container structure as claimed in claim 4 wherein said gripping means provided on each of said pair of latching lug means is a groove.

6. A container structure as claimed in claim 1 wherein the endless rim of said container body means defines an endless edge which faces downwardly and is in surrounding spaced relationship with respect to said container body means.

7. A container structure as claimed in claim 6 wherein each of said pair of latching lug means is configured to define a gripping means for releasably engaging the endless downwardly facing edge of the rim of said container body means with said gripping means being in inwardly spaced relationship with respect to the depending peripheral lip of said closure lid means.

8. A container structure as claimed in claim 7 wherein said gripping means defined by each of said pair of latching lug means is a groove.

9. A container structure as claimed in claim 6 wherein each of said pair of latching lug means comprises:

(a) a bead extending inwardly from the inwardly facing surface of the depending peripheral lip of said closure lid means, said bead being disposed proximate the lower edge of the depending peripheral lip of said closure lid means and substantially parallel therewith; and (b) surface means extending upwardly from said bead and set back therefrom toward the inwardly facing surface of the peripheral lip of said closure lid means to provide a groove at the juncture of said bead and said surface means for releasably gripping the edge of the rim of said container body.

10. A container structure as claimed in claim 9 wherein said surface means slopes upwardly from said bead and inwardly toward the inwardly facing surface of the depending peripheral lip of said closure lid means and said bead is arcuate in cross section.

11. A container structure as claimed in claim 1 and further comprising:

(a) said closure lid means having a substantially planar body from the peripheral edge of which the endless peripheral lip thereof depends;

(b) an endless flange depending from said planar body in inwardly spaced relationship with respect to the endless depending peripheral lip, said endless flange having an endless groove formed in the outwardly facing surface thereof; and (c) seal means in the endless groove of the depending flange of said closure lid means and extending therefrom into sealed engagement with the inwardly facing surface of said container body means.

12. A container structure as claimed in claim 11 wherein said seal means is demountably carried in the groove provided in the depending flange of said closure lid means.

13. A container structure comprising in combination:

(a) a container body of substantially circular cross section and defining an open top which is circumscribed by an endless rim which has a downwardly facing endless edge which is in spaced circumscribing relationship with said container body;

(b) a closure lid of substantially circular planar configuration on the endless rim of said container body for closing the open top thereof, said closure lid having an endless depending peripheral lip which is in concentric outwardly spaced relationship with respect to the endless rim of said container body; and (c) at least a pair of latching lug means in spaced relationship on the inwardly facing surface of the peripheral lip of said closure lid, each of said pair of latching lug means defining gripping means which is in releasable engagement with the downwardly facing edge of the rim of said container body.

14. A container structure as claimed in claim 13 wherein the gripping means defined by each of said pair of latching lug means is in the form of a groove which is substantially parallel with the bottom edge of the depending peripheral lip of said closure lid.

15. A container structure as claimed in claim 13 wherein each of said pair of latching lug means comprises:

(a) a bead extending integrally and inwardly from the depending peripheral lip of said closure lid, said bead being disposed proximate and coextensive with the bottom edge of the depending peripheral lip of said closure lid; and (b) surface means extending upwardly from said bead and set back therefrom toward the depending peripheral lip of said closure lid to provide the gripping means of said latching lug means at the juncture of said bead and said surface means.

16. A container structure as claimed in claim 15 wherein the gripping means provided at the juncture of said bead and said surface means is in the form of a notch which is substantially parallel with the bottom edge of the peripheral lip of said closure lid.

17. A container structure as claimed in claim 16 wherein said surface means slopes upwardly from said bead and inwardly toward the depending peripheral lip of said closure lid.

18. A container structure as claimed in claim 15 wherein said bead is of arcuate cross section.

19. A container structure as claimed in claim 13 and further comprising:

(a) an endless substantially circular in cross section flange depending from the planar body of said closure lid in inwardly spaced concentric relationship with respect to the depending peripheral lip thereof, said flange having an annular groove formed in the outwardly facing surface thereof; and (b) seal means in the annular groove of said flange and extending therefrom into sealed engagement with the inwardly facing surface of said container body.

20. A container structure as claimed in claim 19 wherein said seal means is demountably carried in the annular groove provided in said flange.

* * * * *